US010722011B2

(12) United States Patent
Grund et al.

(10) Patent No.: US 10,722,011 B2
(45) Date of Patent: Jul. 28, 2020

(54) COSMETIC SYSTEM

(71) Applicant: And.B, LLC, New York, NY (US)

(72) Inventors: Bobbie Lynn Grund, New York, NY (US); Andrea DeVos Abraham, New York, NY (US)

(73) Assignee: And.B, LLC, New York, NY (US)

( * ) Notice: Subject to any disclaimer, the term of this patent is extended or adjusted under 35 U.S.C. 154(b) by 1123 days.

(21) Appl. No.: 14/966,134

(22) Filed: Dec. 11, 2015

(65) Prior Publication Data

US 2016/0198819 A1 Jul. 14, 2016

Related U.S. Application Data

(60) Provisional application No. 62/091,210, filed on Dec. 12, 2014.

(51) Int. Cl.

| | |
|---|---|
| ***A45C 5/00*** | (2006.01) |
| ***A45C 7/00*** | (2006.01) |
| ***A45C 15/04*** | (2006.01) |
| ***A45C 15/06*** | (2006.01) |
| ***A45C 13/10*** | (2006.01) |

(52) U.S. Cl.

CPC ..... *A45C 5/005* (2013.01); *A45C 5/00* (2013.01); *A45C 7/005* (2013.01); *A45C 7/0045* (2013.01); *A45C 7/0054* (2013.01); *A45C 13/1069* (2013.01); *A45C 15/04* (2013.01); *A45C 15/06* (2013.01)

(58) Field of Classification Search

CPC ..... A45C 5/005; A45C 7/0045; A45C 7/0054; B65D 69/00

USPC ..... 206/581

See application file for complete search history.

(56) References Cited

U.S. PATENT DOCUMENTS

| | | | | |
|---|---|---|---|---|
| D352,604 | S | 11/1994 | Johnson | |
| 6,109,442 | A * | 8/2000 | Roegner | A45C 11/00 150/106 |
| D441,190 | S | 5/2001 | Eskandry | |
| 6,427,475 | B1 * | 8/2002 | DeFelice | F25D 3/08 62/457.2 |
| D497,051 | S | 10/2004 | Nieves | |
| D501,997 | S | 2/2005 | Hassett | |
| D560,361 | S | 1/2008 | Huang | |
| D632,079 | S | 2/2011 | Spencer et al. | |
| D655,084 | S | 3/2012 | Shor et al. | |
| D659,998 | S | 5/2012 | Austin | |
| D665,170 | S | 8/2012 | Lipfert et al. | |
| D669,270 | S | 10/2012 | Phillips et al. | |
| D690,513 | S | 10/2013 | Phillips et al. | |
| D712,144 | S | 9/2014 | Albanese | |

(Continued)

*Primary Examiner* — Anthony D Stashick

*Assistant Examiner* — Raven Collins

(74) *Attorney, Agent, or Firm* — Warner Norcross + Judd LLP

(57) ABSTRACT

The specification provides a system and carrying case for cosmetics and/or accessories that includes panels with one or more detachable independent carriers to use separate from the case. The independent carriers can be arranged to define a space an interior space for cosmetics or accessories, or may be arranged in an open, expanded position with the panels to define a vanity with a mirror. The independent carriers may have associated panels from which the carriers selectively detach. The panels may also be separable from the case. The system and case may be portable.

12 Claims, 17 Drawing Sheets

(56) References Cited

U.S. PATENT DOCUMENTS

| | | | | |
|---|---|---|---|---|
| D723,804 | S | 3/2015 | Coleman | |
| D748,915 | S | 2/2016 | Reyes | |
| 9,345,298 | B2 * | 5/2016 | Bettua | A45C 5/03 |
| 10,045,597 | B2 * | 8/2018 | Caruth | A61J 7/0084 |
| 2004/0195135 | A1 * | 10/2004 | Seamon | A45C 11/008 206/459.1 |
| 2006/0042993 | A1 * | 3/2006 | Tuhkru | A45C 11/008 206/581 |
| 2012/0012624 | A1 * | 1/2012 | Marrero | A45F 5/021 224/183 |

* cited by examiner

COSMETIC SYSTEM

This application claims the benefit of U.S. Provisional Patent Application No. 62/091,210, filed on Dec. 12, 2014 which is incorporated herein in reference in its entirety.

TECHNICAL FIELD AND BACKGROUND OF THE INVENTION

The present invention generally relates to a system for managing cosmetics and fashion accessories, and more specifically to such system with cases and a mirror which are optionally separable components.

Finding a location for applying makeup can be difficult, especially when shower facilities are shared among more than one person or when the application of makeup is needed or desired just after bathing or showering. Often a person wishing to apply makeup will have a mirror and cosmetics in the bathroom. However, access to the bathroom may not be available if another person uses the same bathing or showering facilities. Even if shower facilities are not shared, the bathroom may be damp or steamy during the time a person wishes to apply makeup.

Reapplying makeup on the go or between functions when a person is away from home is also a challenge. Adequate lighting is frequently unavailable and a mirror, if available, may not be placed conveniently for use. Further, a complete set of cosmetics, applicators, and accessories can be difficult to assemble and organize.

Regardless of the timing and location for the application or reapplication of cosmetics, there are instances in which a user may wish to carry only a portion of a cosmetic and/or accessory collection for particular purposes. Reorganizing a portion of a cosmetic and/or accessory collection for such instances can be time consuming.

SUMMARY OF THE INVENTION

Accordingly, a system for managing cosmetics and/or accessories is disclosed that includes a case with organized panels and, optionally, detachable independent carriers to use separate from the case.

In one embodiment, a system includes a cosmetic case with a base, an independent carrier, a plurality of interconnected panels with at least one of the interconnected panels having an associated panel for supporting the independent carrier. The interconnected panels are operable to be in a closed position relative to the base to define an interior space that will at least partially surround the independent carrier. The interconnected panels are also operable to be in an open position to define a vanity. The independent carrier is selectively detachable from the associated panel. And the interconnected panels are separable from the base. Optionally, the system and/or case may be portable.

In another embodiment, the independent carrier has a palette of color cosmetics.

In another embodiment, the independent carrier is a bi-fold carrier capable of folding together around the palette of color cosmetics.

In one aspect, in any of the above, the case may include a mirror. Optionally, the mirror can be lighted.

In another embodiment, a cosmetic case includes a cover with first and second portions defining a cavity there between, a mirror associated with the first portion, and a tri-fold insert associated with second portion. The tri-fold insert has a plurality of panels that are foldable relative to one another. One or more panels may be removable. Each panel includes an associated independent carrier, which are separable from the panels.

In a further embodiment, the mirror may be adjustable within the case. In addition, the mirror may comprise a mirror assembly and include a plurality of lights, a power source and light power switch. Optionally or additionally, the mirror is removable from the case and includes a position adjustable stand.

In another aspect, in any of the above, the panels may be arranged in an expanded position to define a vanity.

In one embodiment, a system for managing cosmetics and accessories includes a carrying case with first and second portions defining an interior space there between. The system further includes a plurality of interconnected panels. Each panel is foldable relative to an adjacent panel and supports an associated independent carrier. The carriers are removably attached to their respective panel. The system also includes a mirror in the case. In a first configuration, the panels are folded in a closed position and secured in the case. In a second configuration, the panels are unfolded and arranged relative to the mirror to define a vanity. In a third configuration, the panels are separated from the case.

Accordingly to yet another embodiment, a portable cosmetic case has a plurality of interconnected carriers, each having an interior surface and an external surface. The carriers can be arranged in a closed position to define an interior space. Further, each carrier is selectively detachable as an independent carrier.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Figure 1:
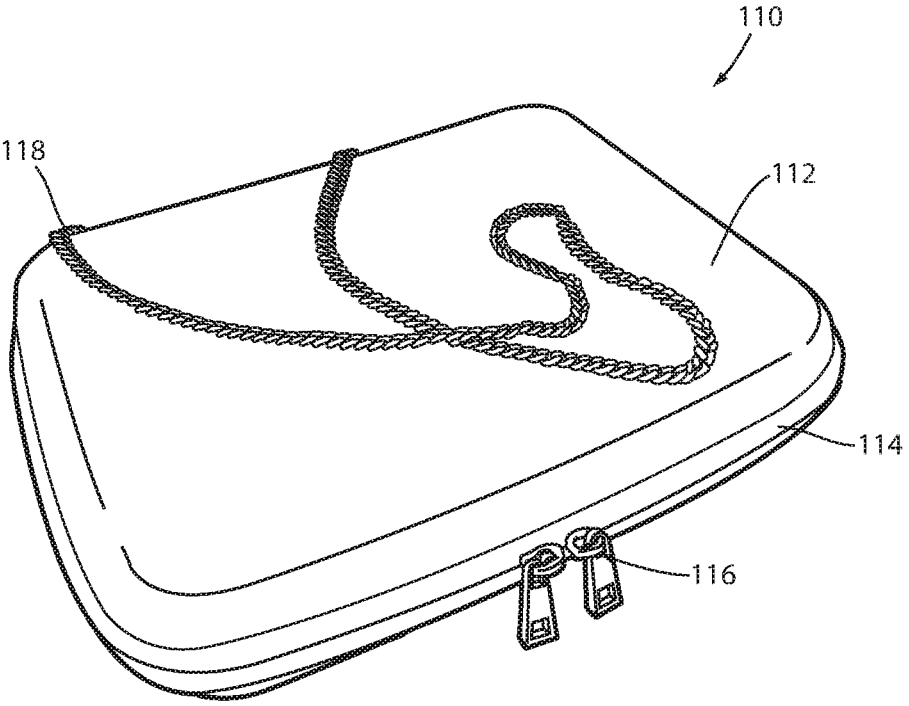
FIG. 1 is a front perspective view of a cosmetic carrying case.

Referring to FIG. 1, the numeral 110 generally designates a cosmetic carrying case. As will be more fully described below, the cosmetic carrying case 110 is adapted to house a plurality of interconnected panels inserted into the case 110. The term "panel" is used herein to refer to a flat or curved component that forms a surface to which cosmetic containers, cosmetic applicators, separable carriers, and accessories may be selectively attached or detached. As will be more fully described below, the interconnected panels may be removed as an assembly for use as a vanity. In addition, the panels may support independent carriers that are separable from the panels. The term "carrier" is used herein to refer to a thing that carries, or holds something, for example a carrier may hold cosmetic containers, cosmetic applicators, one or more accessories, or sets containing a combination of any of the foregoing items. Furthermore, the panels and carriers may be adapted so they can be reconfigured to change the organization of the portable vanity or to selectively remove one or more carriers so that they can be used independently of the case and the panels.

Figure 2:
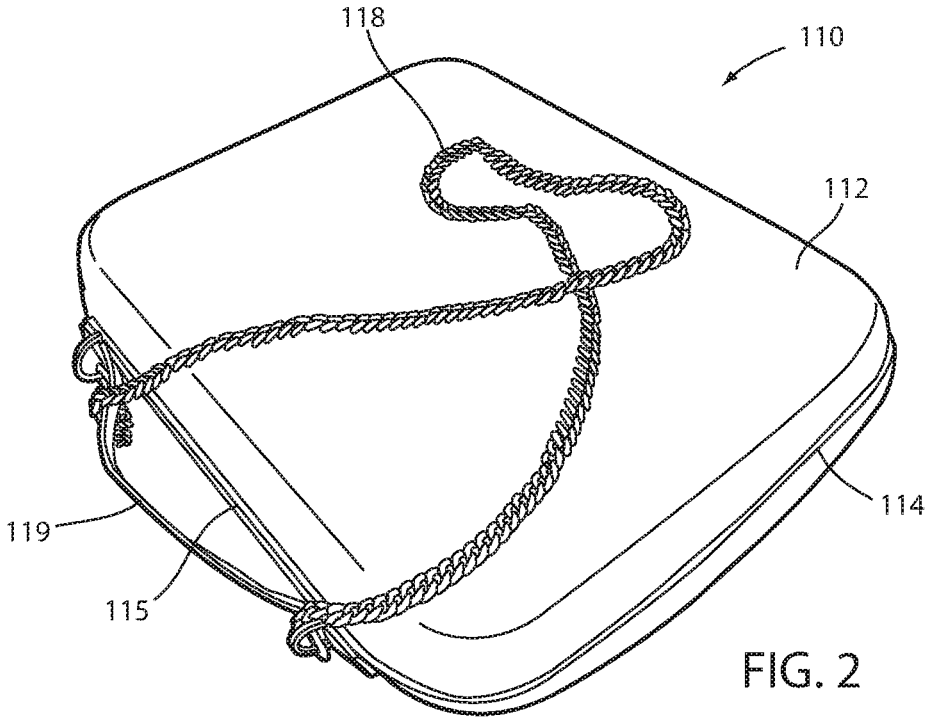
FIG. 2 is a rear perspective view of the cosmetic carrying case of FIG. 1.
Figure 3:
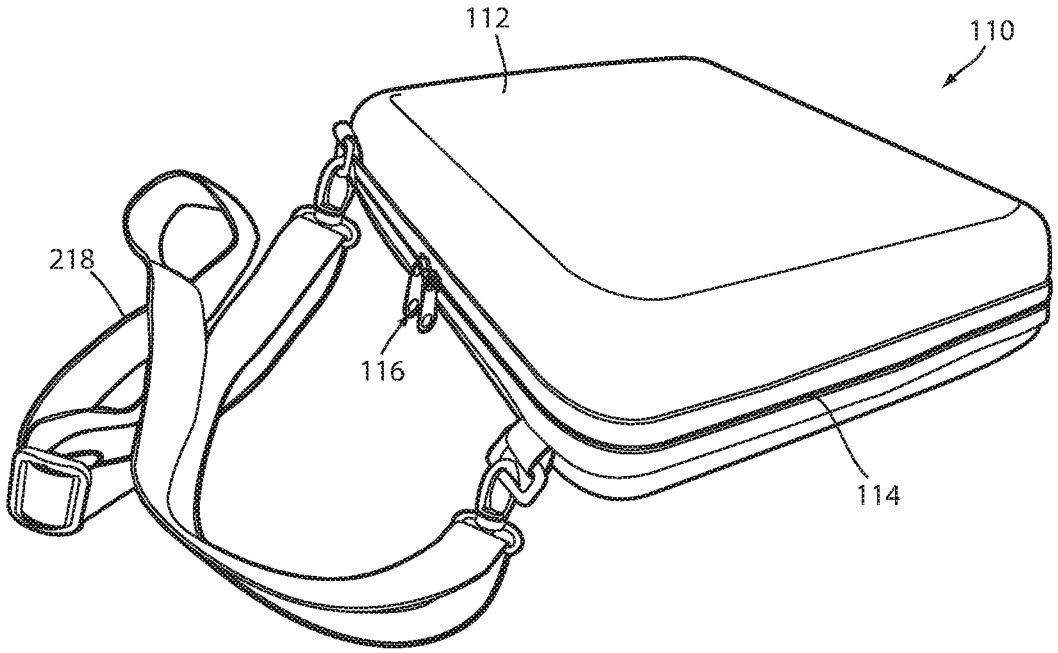
FIG. 3 is another perspective view of the cosmetic carrying case.
Figure 4:
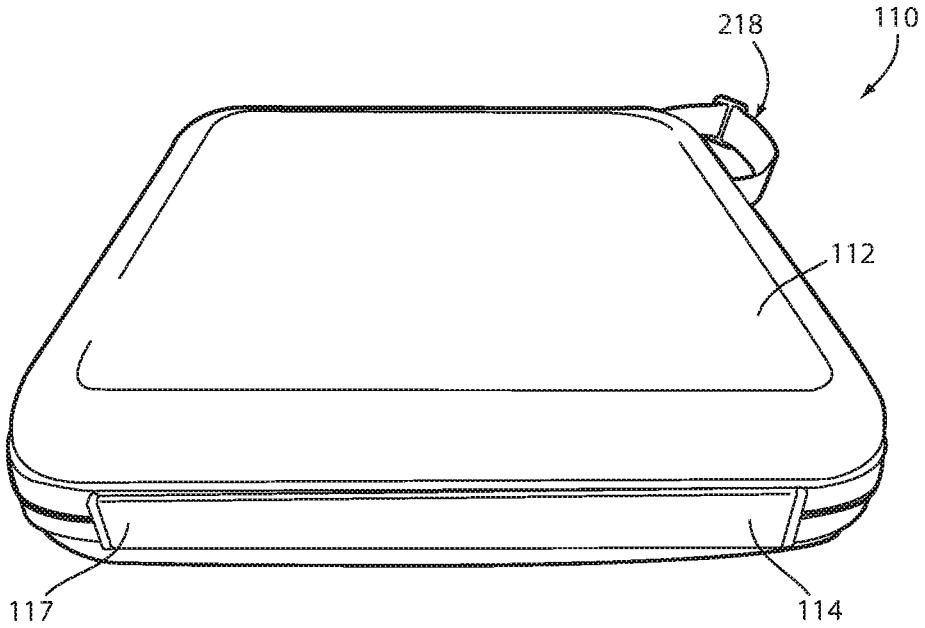
FIG. 4 is a rear perspective view of the carrying case of FIG. 3.

As shown in FIGS. 1 and 2, case 110 includes a first or top portion 112 connected to a second or bottom portion 114 by a hinge 115. For example, hinge 115 may be formed by a flexible strip or narrow panel that is joined along each of its edges to a respective portion of the case. The case 110 may include a closure, such as a zipper closure 116 shown in FIG. 1. The case 110 may also include a strap such a chain 118 and/or a handle 119. Alternately, as shown in FIGS. 3 and 4, case 110 may include a strap in the form of a woven or unwoven fabric, leather, or faux leather such as polyurethane, for example. The strap 118 and/or handle 119 may be adjustable in length and/or detachable from the case 110. The dimensions of the case may be about 11 inches by about 10 inches with a thickness of between about 1.5 and 2.5 inches.

Figure 5:
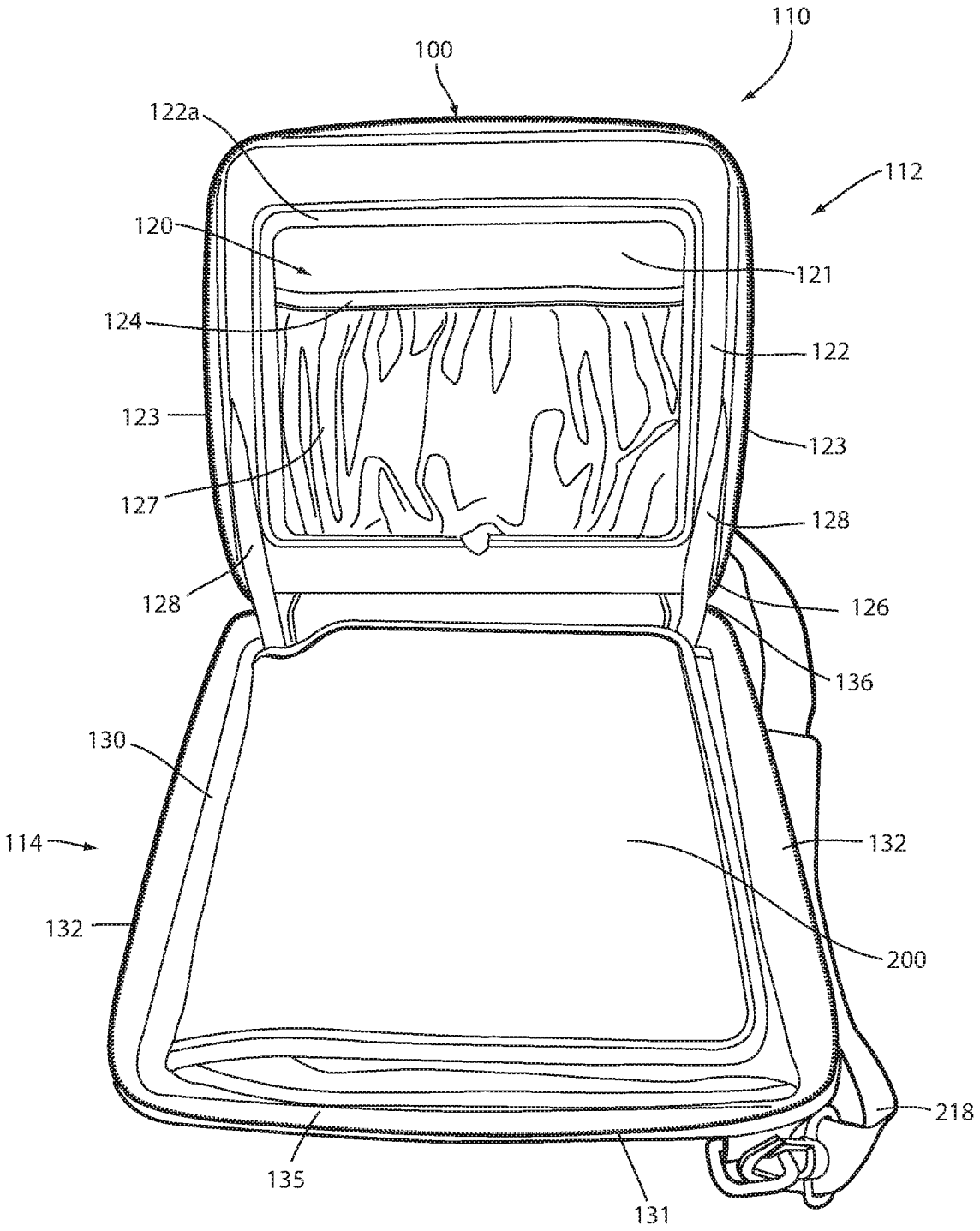
FIG. 5 is a perspective view of the carrying case of FIG. 3 in an open position.

Referring to FIGS. 3-5, the case 110 may be part of a system 100 for managing cosmetics and/or accessories, the top portion 112 can be moved to an open position to provide access to the interior of case 110. Top portion 112 may include an upper cavity 120 in which an item, for example a mirror (described more fully below), may be placed. Top portion 112 includes a back wall 121 and outwardly depending side walls 123, top wall 125, and bottom wall 126, which together form cavity 120. The mirror placed in the upper cavity 120 may be viewed through the opening 127 formed by walls 123, 125, and 126, which can be framed by a perimeter cushion 122 and an inner perimeter frame 122*a*, also formed by a cushion material. Cushion 122 and frame 122*a* are sized so that they can hold the mirror in cavity 120 and, further, protect the edges of the mirror. The opening may include a layer of sheer mesh material or netting (not shown) that extends over the mirror when the mirror is inserted in the upper cavity 120. Cushion 122 and frame 122*a* may be constructed of foam, for example ethylene-vinyl acetate ("EVA") foam and are removable from cavity 120, for example, when the mirror is not being supported in case 110.

Upper cavity 120 may also include a pocket 124 formed by a sheet of material secured on three sides to the back wall 121. In this manner, when the mirror is removed, the pocket will be accessible, with or without removing cushion 122 and frame 122*a*.

To limit the angle of travel between the top portion 112 and bottom portion 114, case 110 includes straps 128, which are anchored, such as by stitching or welding their respective ends to the respective top and bottom portions 112 and 114. The straps 128 may be adjustable to allow for the adjustment of the angle of a mirror, discussed below. Alternatively, the mirror may include hooks with adjustable straps (not shown) associated with the top portion 112 to adjust the position of the mirror. In this manner, when the mirror is supported in cavity 120 and the bottom portion 114 of the case 110 is placed on a flat surface, the mirror can be positioned so that a user may easily view his or her refection in the mirror. For example, the angle of the mirror relative to bottom portion 114 may be between 90° and 135° or may be substantially 90°.

Figure 10:
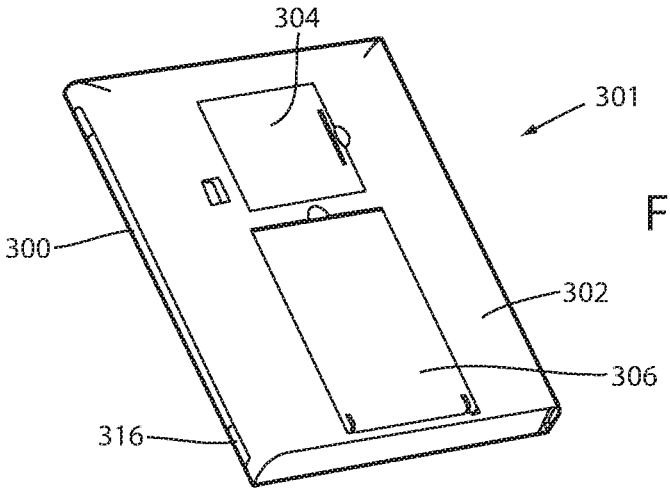
FIG. 10 is a rear perspective view of a mirror assembly with a stand.
Figure 11:
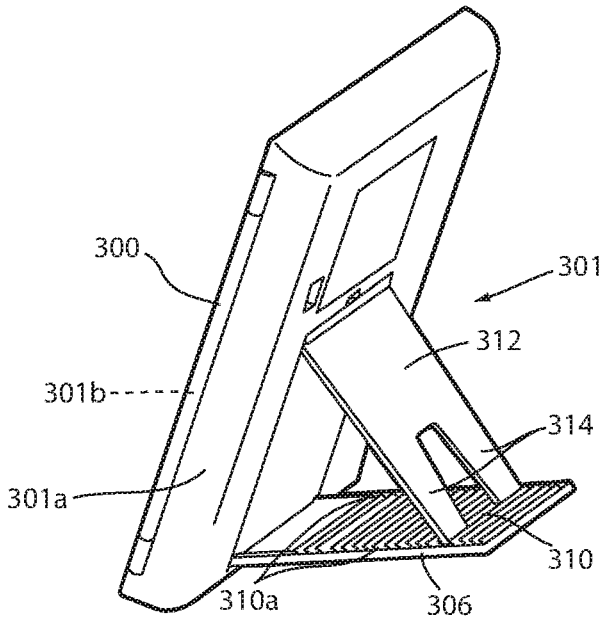
FIG. 11 is a rear perspective view of the mirror assembly of FIG. 10 illustrating the stand in a deployed position.

A suitable mirror 300, such as shown in FIGS. 10 and 11, may comprise a lighted mirror assembly 301. For example, mirror assembly 301 may include a housing 301*a*, which supports a mirror element 301*b* and a plurality of lights 301*c*, such as LED lights. Also supported by housing 301*a* is a power panel 304 that may, for example, house batteries that power lights 301*c*, as controlled by a power switch 316. For example, power panel 304 may be mounted in a recess provided in the rear wall 302 of housing 301*a*. Switch 316 may be the main power switch for powering the lights 301*c* and can be mounted along an edge of mirror element 301*b*, for easy access.

Figure 10A:
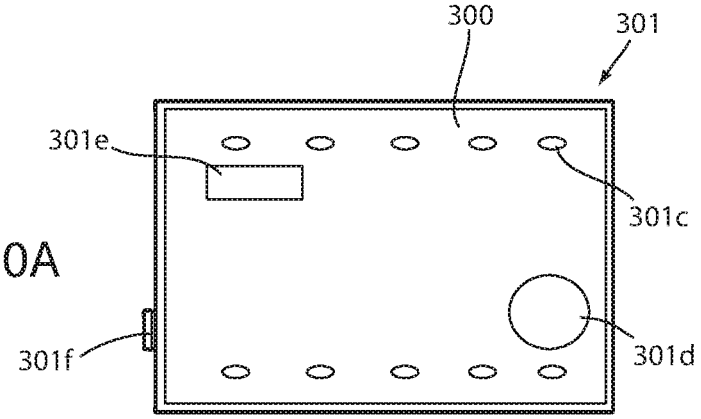
FIG. 10A is a front elevation view of the mirror assembly of FIG. 10.

The lights may be powered in a variety of ways intended to conserve power. For example, a two-switch system may be included such that the main power switch, for example switch 316, controls power to a soft or secondary power switch, such as switch 317 as shown in FIG. 10A. If the main power switch is on, the user may power the lights 301*c* on and off by pressing the secondary switch 317. Additionally or alternatively, the lights 301*c* may power on if the main switch is on and a motion sensor (not shown) detects movement in front of the mirror element 301*b*. The motion sensor may also cause the lights 301*c* to power off after a period of time during which no movement is detected in front of the mirror element 301*b*. Further, a plunger switch (not shown) may turn on the lights 301*c* upon opening of the case containing the mirror 300, and may power off the lights 301*c* upon closing of the case.

The mirror 300 may be positioned within the system inside the case 110 or any other case described herein. The position of the mirror 300 may be adjusted within the case by adjusting the length of the straps 128 between the top portion 112 and bottom portion 114 of the case 110.

In addition, housing 301*a* may include a foldout stand 306 for adjusting the position of the mirror 300 when the mirror 300 is removed from the case 110. Stand 306 may also be mounted in a recess formed in rear wall 302 of housing 301*a* and configured to move between a stowed position (see FIG. 10) in a deployed position (see FIG. 11). Stand 306 may be formed by two relatively ridged panels 310 and 312, which are hinged to housing 301*a*, with panel 310 forming a base for panel 312 to engage to maintain the stand in its propped position. For example, panel 310 may include several integral or separately molded ridges 310*a* between which panel 312 extends to maintain the stand in its deployed position to form a prop for mirror assembly 301.

As shown in FIG. 11, panel 312 may be formed with a pair of legs 314 that can engage panel 310 between ridges 310*a*. The angle of the mirror 300 relative to the surface upon which the mirror 300 can therefore be adjusted based on which ridges the legs 314 engage.

In addition, mirror assembly 301 may include a curved mirror 301*d* to form a magnifying mirror. Mirror 301*d* may be adhered to mirror element 301*b* or mounted by a releasable mechanism, such as VELCRO patches or a suction cup. Further, mirror assembly 301 may include a display 301*e*, including a digital display, for example, to display the time, date or other information. In addition, mirror assembly 301 may include a microprocessor and a power source, such as battery, which may be in communication with display 301*e* to control the images at display 301*e* and in communication with one or more ports 301*f* located at housing 301*a*, for example, at the side of housing 301*a*. For example, the port or ports may form a charger outlet, for example, a cell phone charger outlet, or a UBS port to allow an electronic device to be in communication with the microprocessor. The electronic device may comprise a cell phone or handheld computer, such as an iPad or the like, so that information may be display from the device at display 301*e* or simply allow communication between the electronic device and the microprocessor. Additionally, mirror assembly 301 may also incorporate a microphone and one or more speakers, and also a camera, which are in communication with the microprocessor. The microprocessor is configured to communicate with a phone coupled to one of the ports (i.e. a USB port) and further to connect the phone with the microphone, speakers, camera and/or display, so that a user who is using the mirror or cosmetic system may talk with someone and, further, optionally have face time with someone via the mirror assembly camera and display. Optionally, the mirror assembly may have a phone cradle (with the USB port integrated into the cradle) so that a user may simply plug the phone into the cradle to connect the phone to the microprocessor of the mirror assembly.

Figure 6:
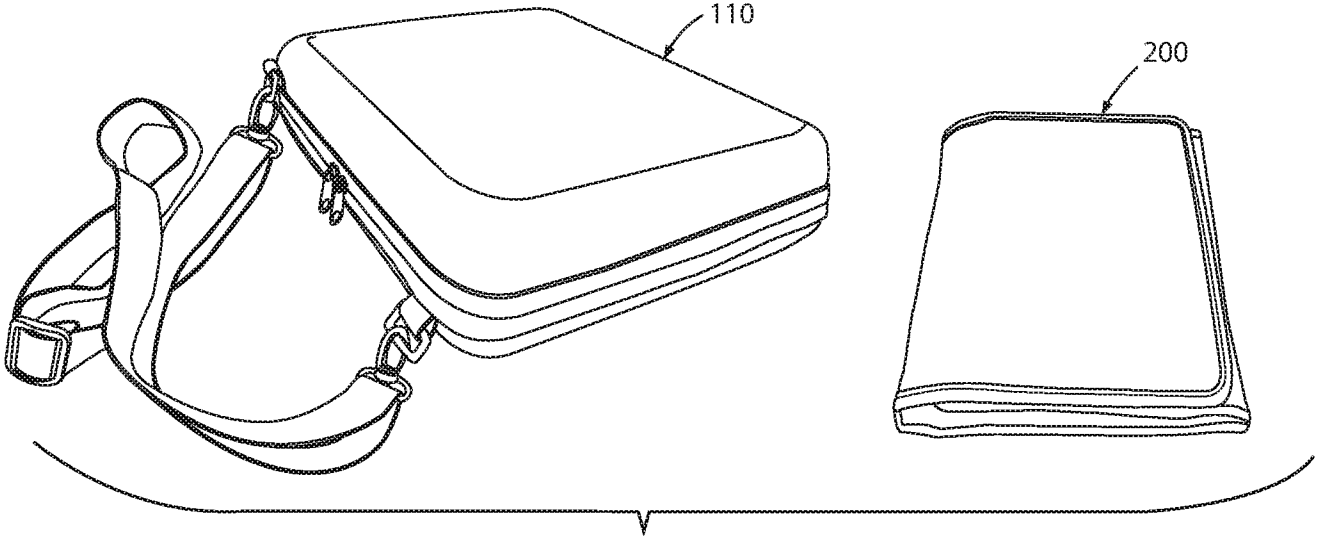
FIG. 6 is a perspective view of the carrying case of FIG. 5 with a separated trifold insert.

Referring again to FIG. 5, lower portion 114 of case 110 may include a lower cavity 130. Lower portion 114 similarly includes a bottom wall 13 land upstanding side walls 132, front wall 135 and rear wall 136, which together form cavity 130. A removable insert 200 may be housed in the lower cavity 130, which can support a plurality of independent carriers and also be configured as a vanity. In the illustrated embodiment, insert 200 comprises a tri-fold multiple panel insert. As best seen in FIG. 6, insert 200 may be separated and removed from the case 110.

Figure 7B:
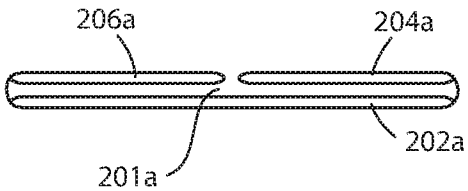
FIG. 7B is an end view of another embodiment of a tri-fold insert with non-overlapping side panels.
Figure 7A:
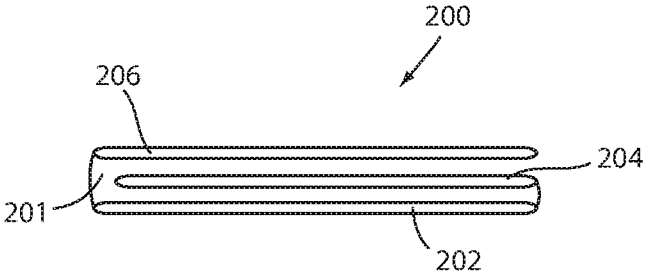
FIG. 7A is an end view of a tri-fold insert with overlapping side panels.
Figure 8:
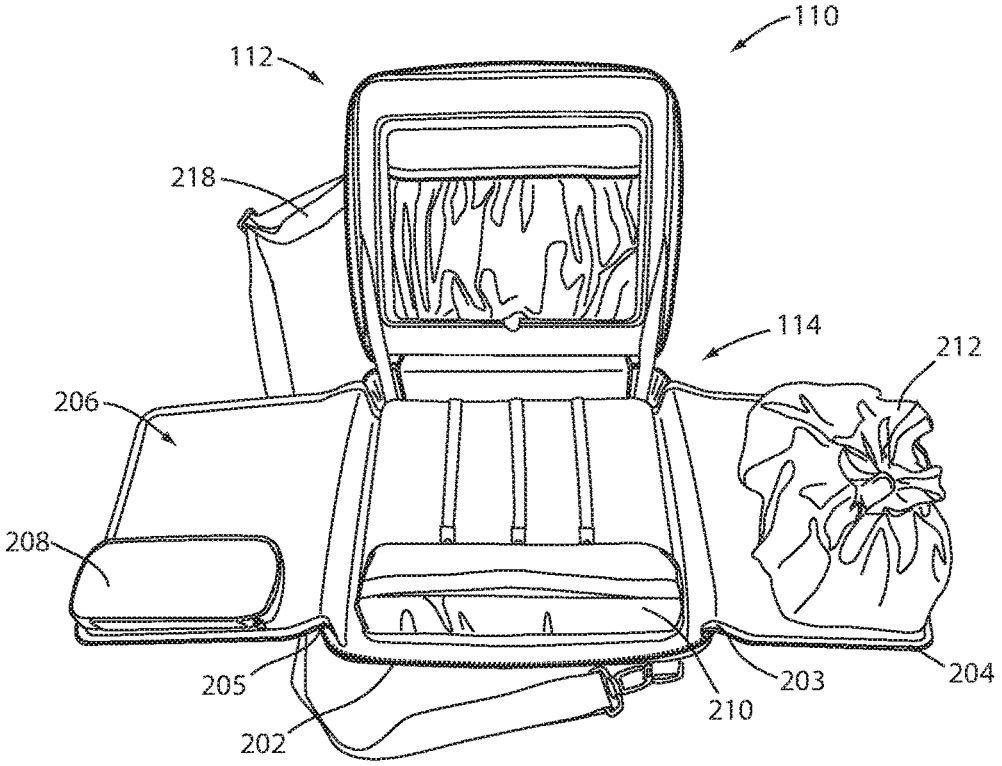
FIG. 8 is a perspective view of the carrying case of FIG. 5 with the tri-fold insert of FIG. 7A attached and in an expanded configuration.
Figure 9:
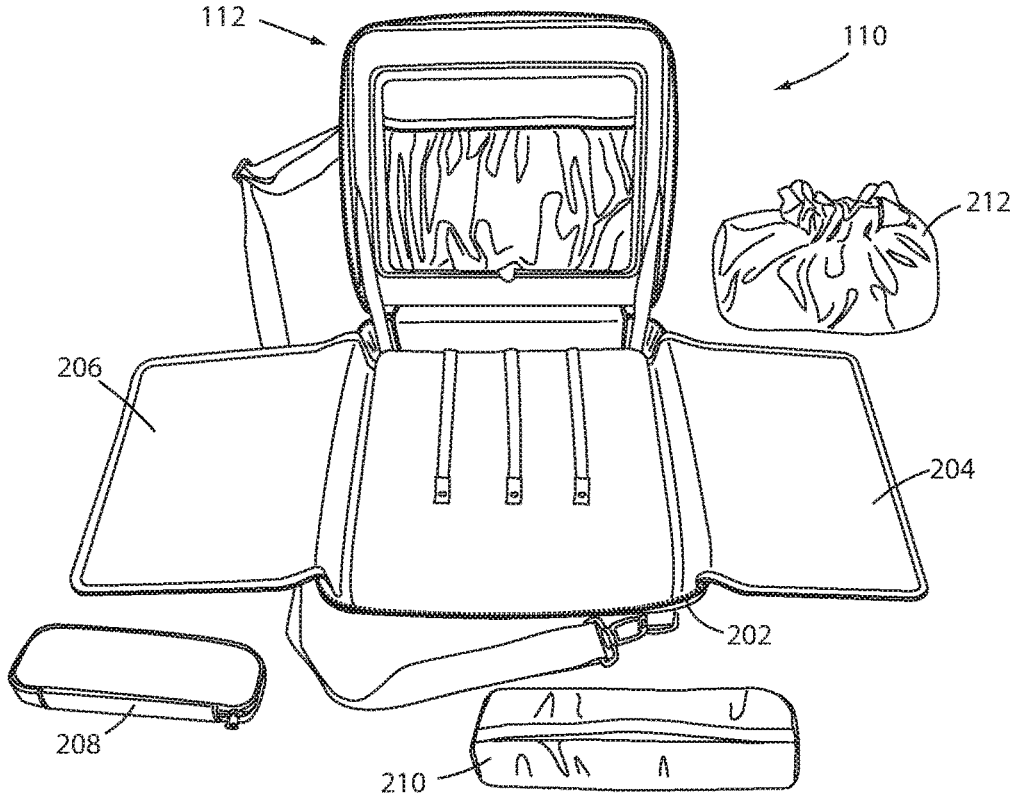
FIG. 9 is a partially exploded perspective view of the carrying case of FIG. 8.

Referring to FIGS. 8 and 9, insert 200 of the system may include a base panel 202, a right panel 204 and a left panel 206. Panels 204 and 206 may have substantially equivalent widths and further be sufficiently wide so that the right panel 204 and left panel 206 can be folded over and overlap each other to cover the base panel 202 and create an internal space 201 (FIG. 7A). Alternatively, insert 200 may include a right panel 204*a* and left panel 206*a* sized so that their free edges do not overlap and instead are adjacent but still create an internal space 201*a*, as shown in FIG. 7B, to house or at least partially enclose the carriers. The tri-fold insert may include a functional and/or decorative tie (not shown) to secure the insert in a folded position. Once the tri-fold insert 200 is removed from the case 110, a pocket (not shown) optionally provided in lower cavity 130 will then be accessible for use in holding other items.

Referring again to FIG. 8, the tri-fold insert 200 may be expanded by folding out the right panel 204 and left panel 206 from the base panel 202 along hinges 203 and 205, respectively, formed, for example, by flexible strips or narrow panels of material that are joined at their respective edges to the respective panels. Further, each of panels 202, 204, 206 may be associated with one or more carriers that are independent from one another and separable from panels 202, 204, 206. For example, the independent carrier may be a cosmetic bag, a cosmetic tool or applicator bag, an accessory bag, or a bag containing any combination of the foregoing. As shown in FIG. 8, a cosmetic bag 208 is associated with the left panel 206, a cosmetic tool or applicator bag 210 is associated with the base panel 202, and an accessory bag 212 is associated with the right panel 204.

The carriers, such as the cosmetic bag 208, cosmetic applicator bag 210, and accessory bag 212, may be attached to the panels 202, 204, 206 by magnetic attraction. For example, the panels 202, 204, 206 may include a magnetic material, and the carriers 208, 210, 212 may include a metal component. A sheet of magnet material may be provided in the construction of the respective panels and may be covered with natural or synthetic material that is woven or extruded. It should be understood that both the carriers and the panels may be magnetized or that the carriers can be magnetized while the panels include a metal portion in their construction. Other type of fasteners, such as mechanical fasteners, may be used to detachably associate the carriers to the panels. For example, the opposing surfaces of the panel and carrier may include corresponding hook and loop fasteners or corresponding pairs of snaps or snap fit elements.

The carriers, such as the cosmetic bag 208, cosmetic applicator bag 210, and accessory bag 212, can be detached from the panels 202, 204, 206 and used remotely from the remaining case 110, panels 202, 204, 206, and the other carriers. As shown in FIG. 9, the cosmetic bag 208 is shown in a separated or detached position relative to the left panel 206, cosmetic applicator bag 210 is shown detached from the base panel 202, and the accessory bag 212 is detached from the right panel 204.

Figure 12:
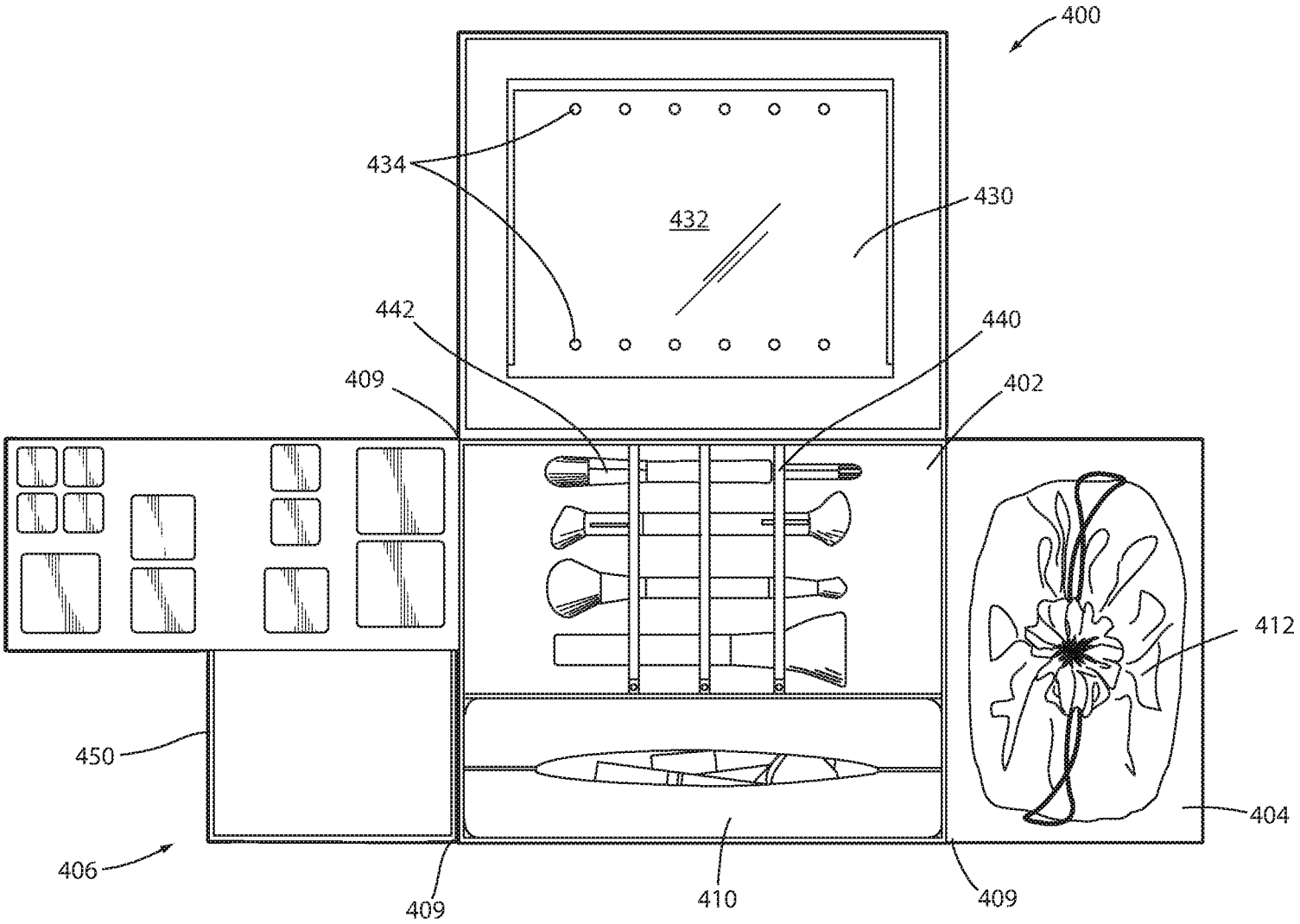
FIG. 12 is a perspective view of another embodiment of an insert shown in an unfolded configuration.
Figure 12A:
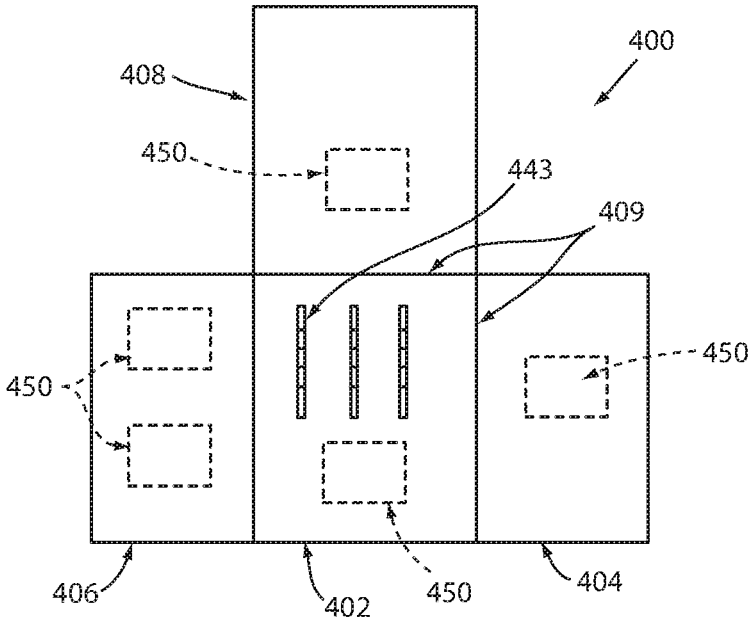
FIG. 12A is a plan view of the insert of FIG. 12, with the carrier and accessories removed for clarity.

Referring now to FIGS. 12 and 12A, the numeral 400 generally designates another embodiment of an insert. Similar to insert 200, insert 400 includes a base panel 402, a right panel 404, a left panel 406, and a cover panel 408, which are all hinged together by hinges 409 so that panels 404, 406 and 408 can be folded over panel 402. For example, each panel may be formed from a sheet of cardboard, which is then enclosed in a polymer sheet, such as a plastic, or sheet of fabric. The seams of each panel are then sealed, for example, by heat sealing, welding or stitching. Each hinge may be formed from a strip of flexible material that is joined along its respective edges, such as by welding or stitching, to the respective panels. As will be described below, base panel 402, right panel 404, and left panel 406 along with the independent carriers may be arranged or organized to form a vanity.

Each panel 402, 404, 406, and 408 may support a removable independent carrier. For example, in the illustrated embodiment, base 402 may support a carrier in the form of a container, such as pouch 410*a*. Panel 404 may support a carrier in the form of another container, such as a bag, including a draw string bag 412. Left panel 406 may support a third carrier in the form as a cosmetic compact 420.

Figure 24:
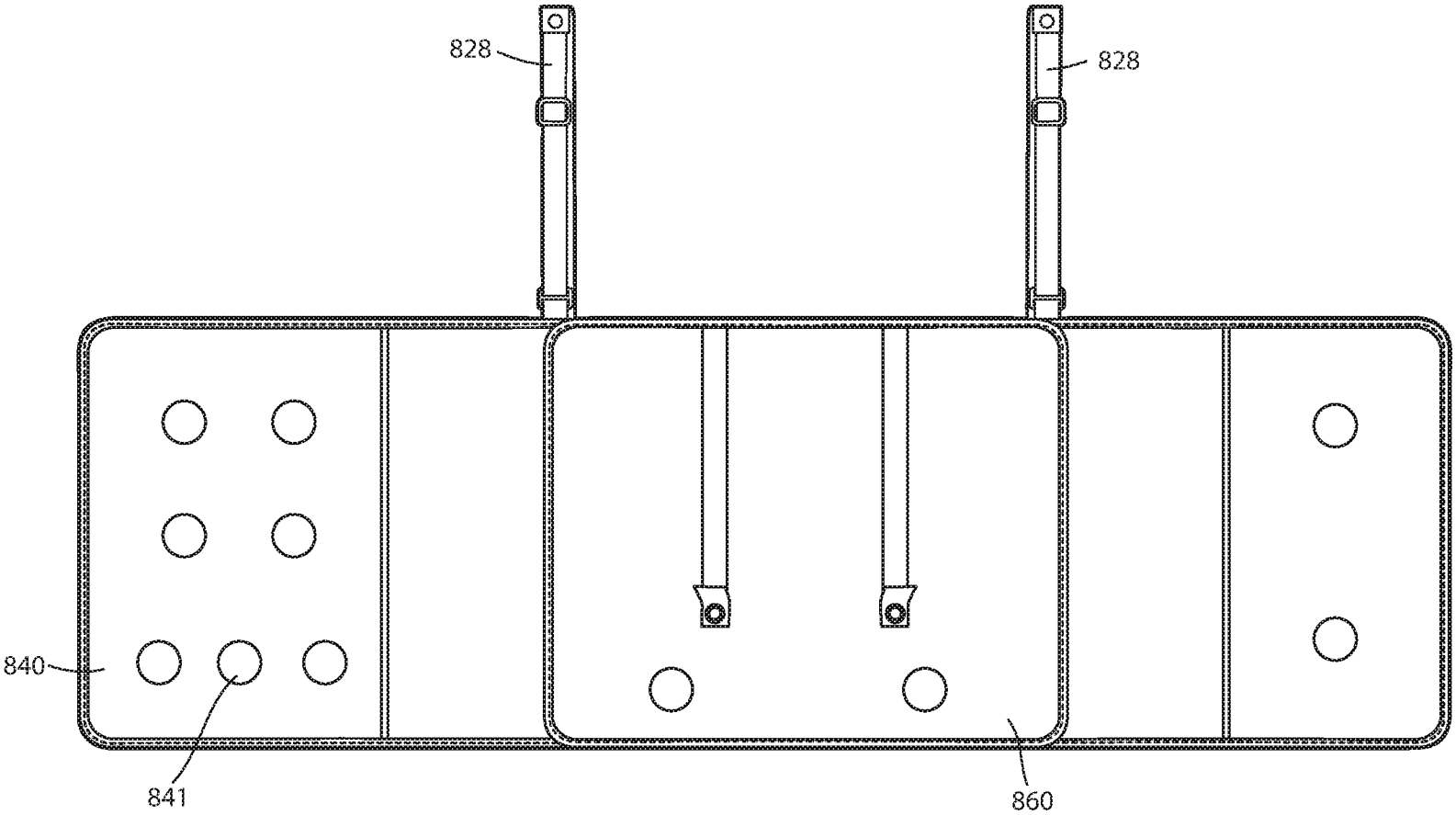
FIG. 24 is a plan view of a trifold and adjustable straps removed from the case.

Further, as noted, each carrier may be removably supported on the respective panel. For example, each carrier and each panel may include couplers 841 to provide releasable attachment of each carrier to its respective panel. Suitable couplers 841 include magnetic couplers, mechanical fasteners (such as snaps), suctions cups or fabric couplers, such as hook and loop fasteners, for example Velcro® fasteners. Magnetic couplers may consist of a magnet, such as a magnetic sticker, which is mounted to either the carrier or the panel, and a metal insert, such as a metal plate, mounted to the other of the carrier or the panel. For example, the magnet may be applied to the outer surface of the carrier, while the corresponding metal insert or magnet may be encapsulated in the panel so they are hidden from view. For example, seven (7) couplers 841 are shown on the left panel 842 of the trifold 860 in FIGS. 21 and 24. When magnets are used, the magnets may be about 20 mm in diameter (2000 Gauss). It should be understood that the inclusion of any number of magnets of any size would be suitable. But it should be understood that the panels may have their magnetic couplers surface mounted instead, as would be the case for the hook and loop fasteners or mechanical fasteners.

In addition to carriers 410, 412, and 420, insert 400 may include a mirror 430 mounted to cover panel 408. Similar to mirror 130, mirror 430 may also comprise a mirror assembly and include one or more lights 434, such as light emitting diodes ("LEDs"). For example, the mirror assembly may also include a power supply and a switch so that lights 434 can be manually turned on or off. Alternately, the switch may comprise a motion switch that turns the lights on in response to motion, for example, when cover portion 408 is raised or by other powering arrangements such as those discussed herein with respect to the mirror 300 of FIGS. 10, 10A, and 11.

Further, base panel 402 may include a plurality of brush holders 440, for example, tension straps. Each strap may be formed from an elastic strand that is secured to panel 402 at spaced locations to form a plurality of loops. Alternatively, each loop may be formed by a separate elastic strand that is secured to panel 402. It should be understood that any number of tension straps may be placed on any available panel 402, 404, 406 space to secure any type of item that may be associated with the vanity 400. Rather than providing a magnetized backing under the portion of the panel with the tension straps 440, the items may be secured by a snug fit under one or more tension straps 440. In order to provide a snug fit for brushes or items of various size, the tension straps 440 may capable of having the length adjusted.

In one embodiment, the brush holders may be formed on a separate, detachable member or base 446, which then forms an independent carrier. For example, the base may be formed from a folding member so that it too is closeable and usable separate and apart from insert 400. Or, the base may be formed from a relatively flexible panel that allows the carrier to be rolled and tied, again to form a separate carrier.

As noted, the carriers associated with the panels 402, 404, 406 need not be limited to bags. Further, compact 420 may have a clam shell or folding construction so that it can be mounted with one or both portions attached to a panel, such as the left panel 406, by magnetic, VELCRO®, or mechanical fasteners, as described above. For example, the right side of the compact may be attached to an upper portion of the left panel 406, leaving the lower portion of panel 406 available for attaching another carrier.

Figure 13A:
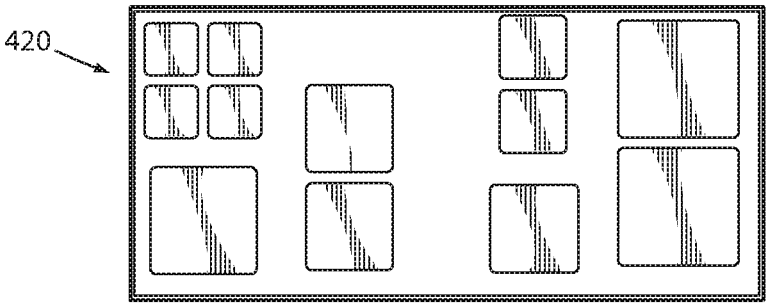
FIG. 13A is a plan view of an independent carrier of the insert of FIG. 12 shown in an open position.
Figure 13B:
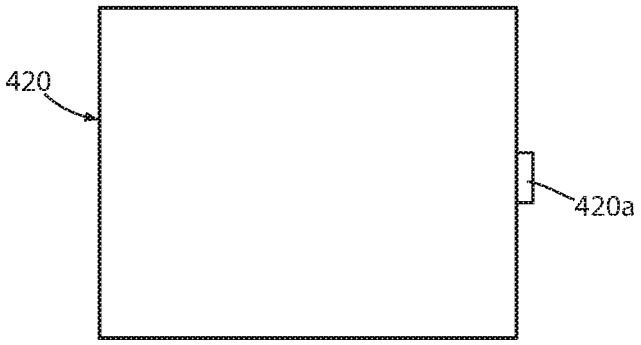
FIG. 13B is a plan view of the independent carrier of the FIG. 13A in a closed position.
Figure 14:
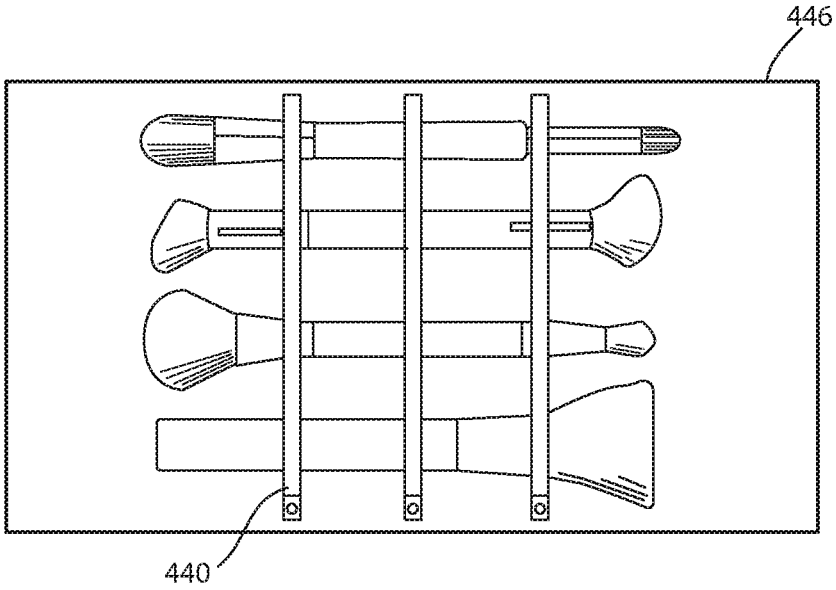
FIG. 14 is a plan view of a second independent carrier of the case of FIG. 12 shown in an open configuration.
Figure 15:
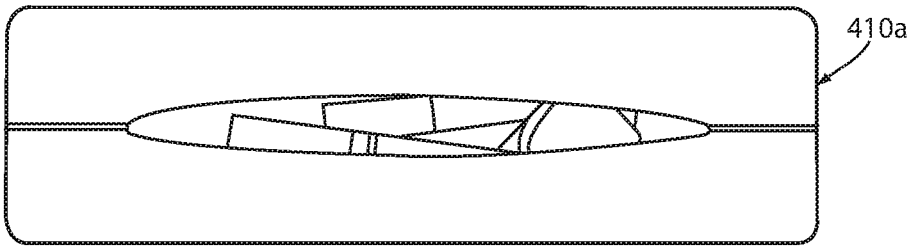
FIG. 15 is a plan view of a third independent carrier separated from the tri-fold insert.
Figure 16A:
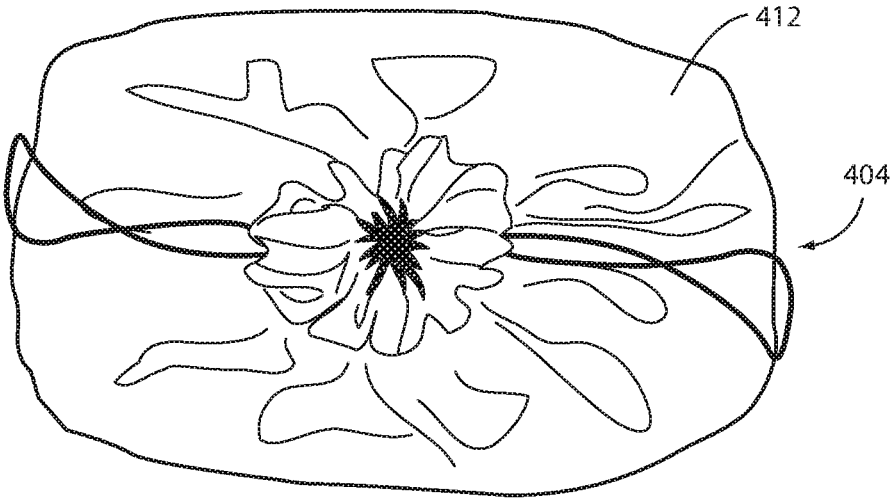
FIG. 16A is a top view of a panel of the tri-fold with an independent carrier in the form of a pouch.
Figure 16B:
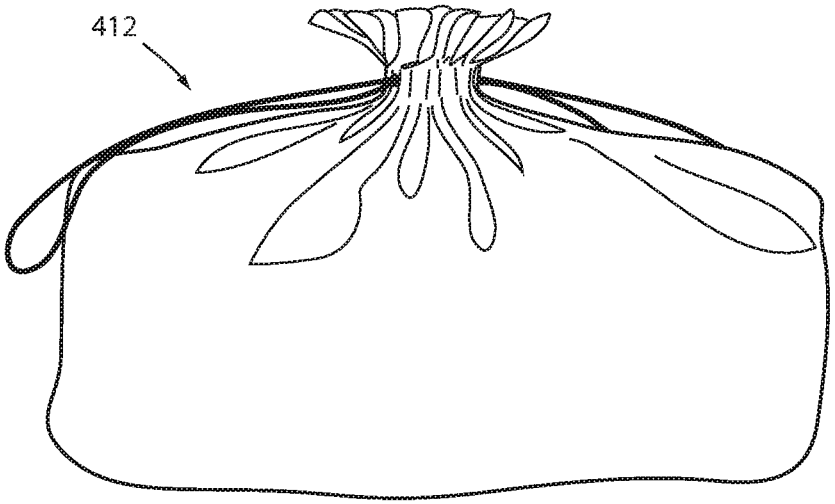
FIG. 16B is a side view of the pouch in FIG. 16A removed from the panel.

Turning now to FIG. 13A, compact 420 may be detached from the panel 406 to be taken away from the remaining components of the insert 400 for independent use. For example, as best seen in FIG. 13B, compact 420 may be folded and secured in its folded configuration by a securement mechanism 420*a* so that it can become an independent makeup compact.

The carrier may also be a tool kit, applicator kit, cosmetic kit, or may contain a combination of cosmetics, tools, applicators, and one or more fashion accessory. As noted, one carrier may be a pouch 410*a* without a closure at the opening. For example, pouch 410*a* may comprise a pinch pouch with resilient sides that form the opening for quick and easy access to the items stored or carried in the pouch 410*a*. Alternatively, the sides of the pouch may be zippered or snapped together, or may form two parts of a magnetized closure. For example, pouch 410*a* may be sized to hold mascara and other eye makeup and application tools and may be removed from the panel 402 and taken away for independent use.

As noted above, container 412 may comprise a drawstring bag 412 for carrying cosmetic and/or accessories. A bag 412 of this type is shown in FIGS. 12 and 17 may be associated with the right panel 404, but may be removed for use remote from the insert 400 or case as described below.

As noted above, each carrier may be mounted by magnetic couplers, such as a magnetized plate 450 shown in FIG. 12A. For example, metallic stickers (not shown) may be provided and attached to an item that can then be magnetically attached to the plate 450 or a panel.

Additionally, a kit including the system, such as system 100, may be provided with metallic stickers so that a use of the system may add an item of their choosing to the system.

Insert 400 may be organized inside a case, such as case 110, with the right and left panels expanded by folding out from the base panel, while the base panel is within the lower cavity (e.g. lower cavity 130) of the case. With this arrangement the right and left panels may fold over the side walls 132 of the lower cavity 130. Optionally, mirror 430 may be removed from insert 400 and set up as described herein in reference to case 110.

The cosmetic carrying case described herein may provide a system of managing cosmetics and accessories by providing a carrying case with a plurality of removable panels and one or more independently removable carriers associated with panels of the case. Along with mirror, a user may fold out the contents of the case including the panels with the associated carriers and the contents of the carriers available for use in as in a vanity in any location with suitable space for unfolding the panels. The system further allows a user the flexibility of removing the carriers so that they can be used independent from the case as self-contained cosmetic carriers with their own covers or containers.

Figure 17A:
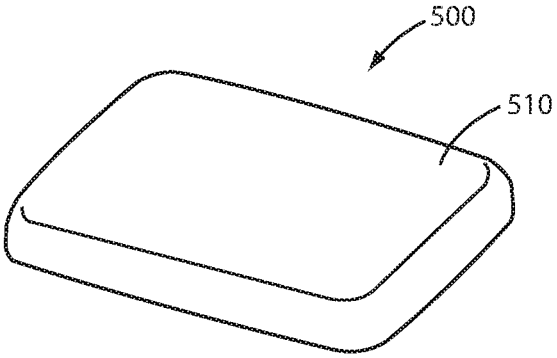
FIG. 17A is a perspective view of a top portion of a case.
Figure 17B:
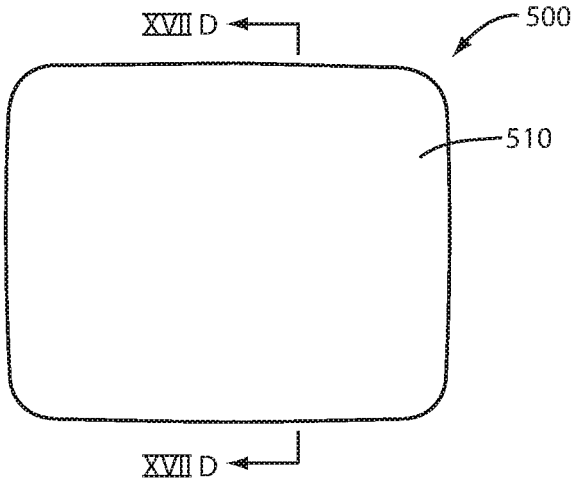
FIG. 17B is a top plan view of a top portion of a case.
Figure 17C:
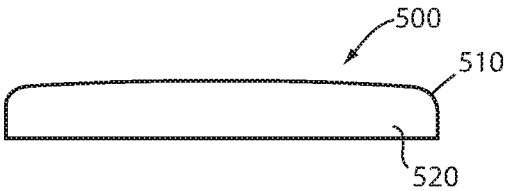
FIG. 17C is an end view of a top portion of a case.
Figure 17D:
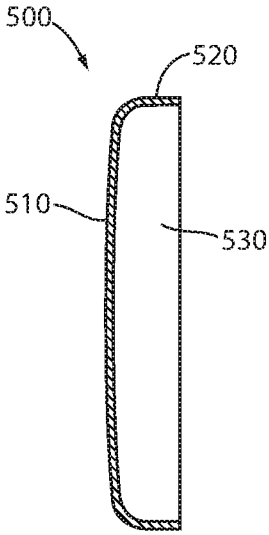
FIG. 17D is a cross-sectional view of the portion of a case shown in FIG. 17B.

In another embodiment, the system may include a case constructed of cushioned foam, such as EVA foam. Referring to FIGS. 17A-17B, a top portion 510 of such a case 500 is shown. An end view of the case 500 is shown in FIG. 17C. The top portion 510 of the case 500 may provide a top cavity 530 of the interior of the case as shown in FIG. 17D.

Alternatively, the case may constructed of a harder material or plastic. For example, in FIG. 18, the top portion 610 of case 600 may be constructed of materials denser than foam.

Figure 19:
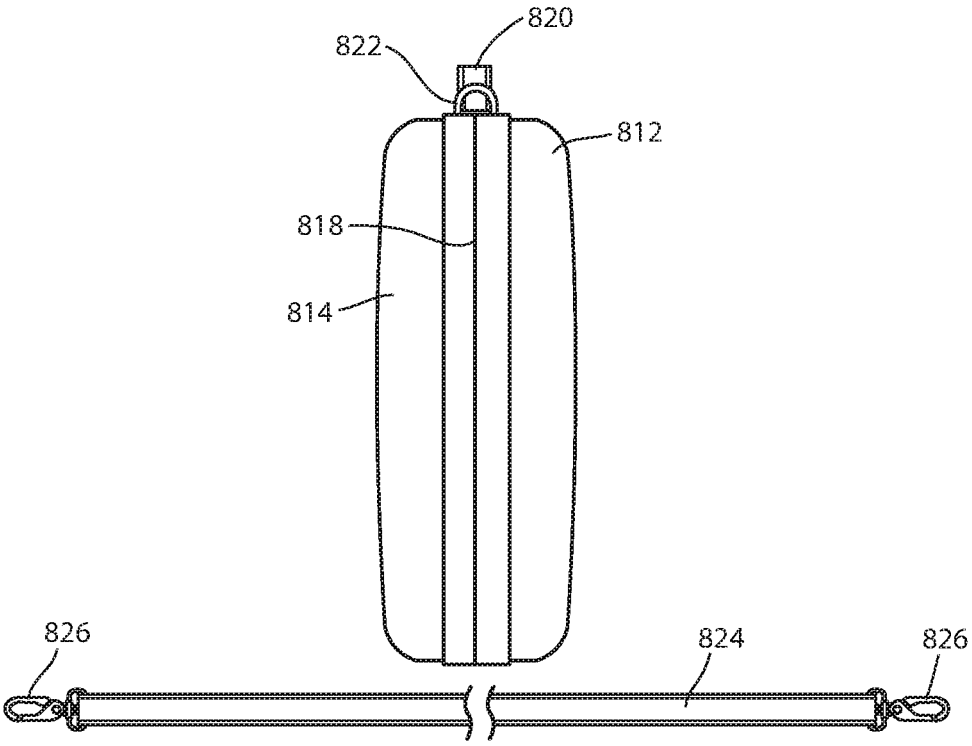
FIG. 19 is a side view of a case, a system, and a detachable strap.
Figure 20:
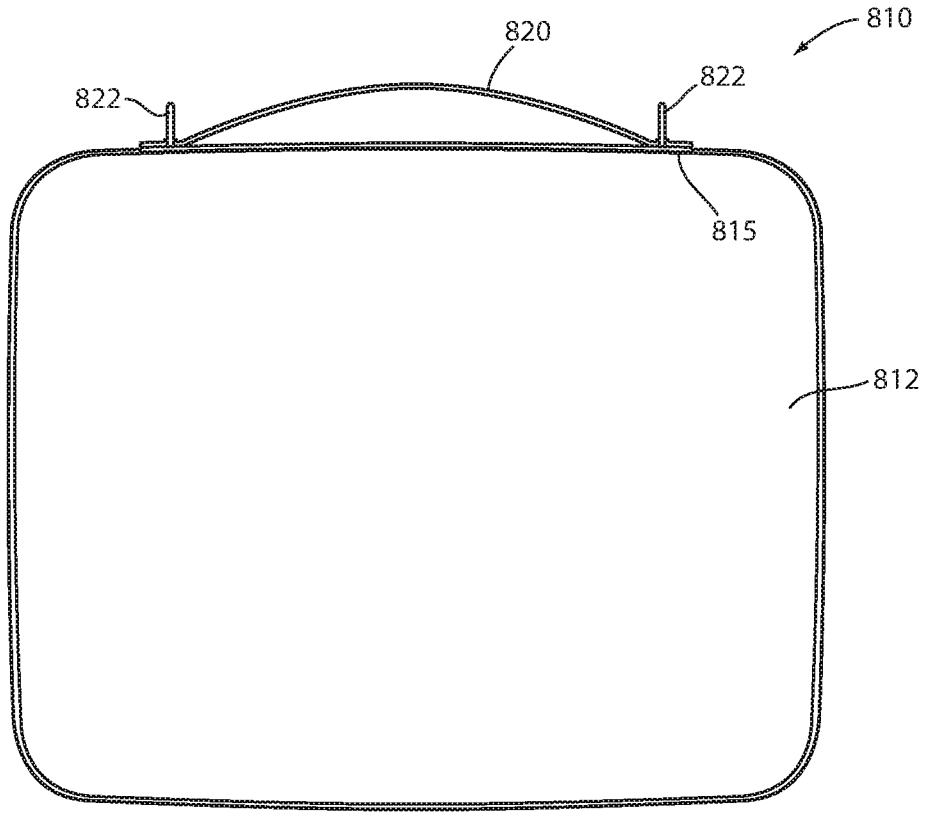
FIG. 20 is top view of the case shown in FIG. 19.

The case 810 of FIGS. 19 and 20 may be soft-sided or hard-sided. The top portion 812 and bottom portion 814 may be joined by a spine 815 and enclosure 818, such as a zipper. A handle 820 for carrying the case 810 may be included. Additionally or alternatively, the case may include rings, such as D-rings 822, to which a strap 824 with clips 826 can be selectively attached or detached from the case 810.

Figure 18:
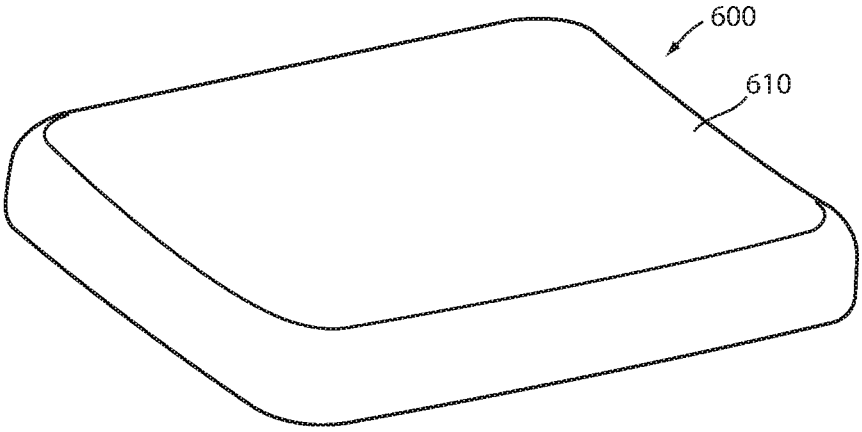
FIG. 18 is a perspective view of another embodiment of a portion of a case.
Figure 22:
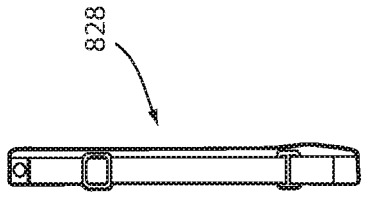
FIG. 22 is a front view of an adjustable strap.
Figure 21:
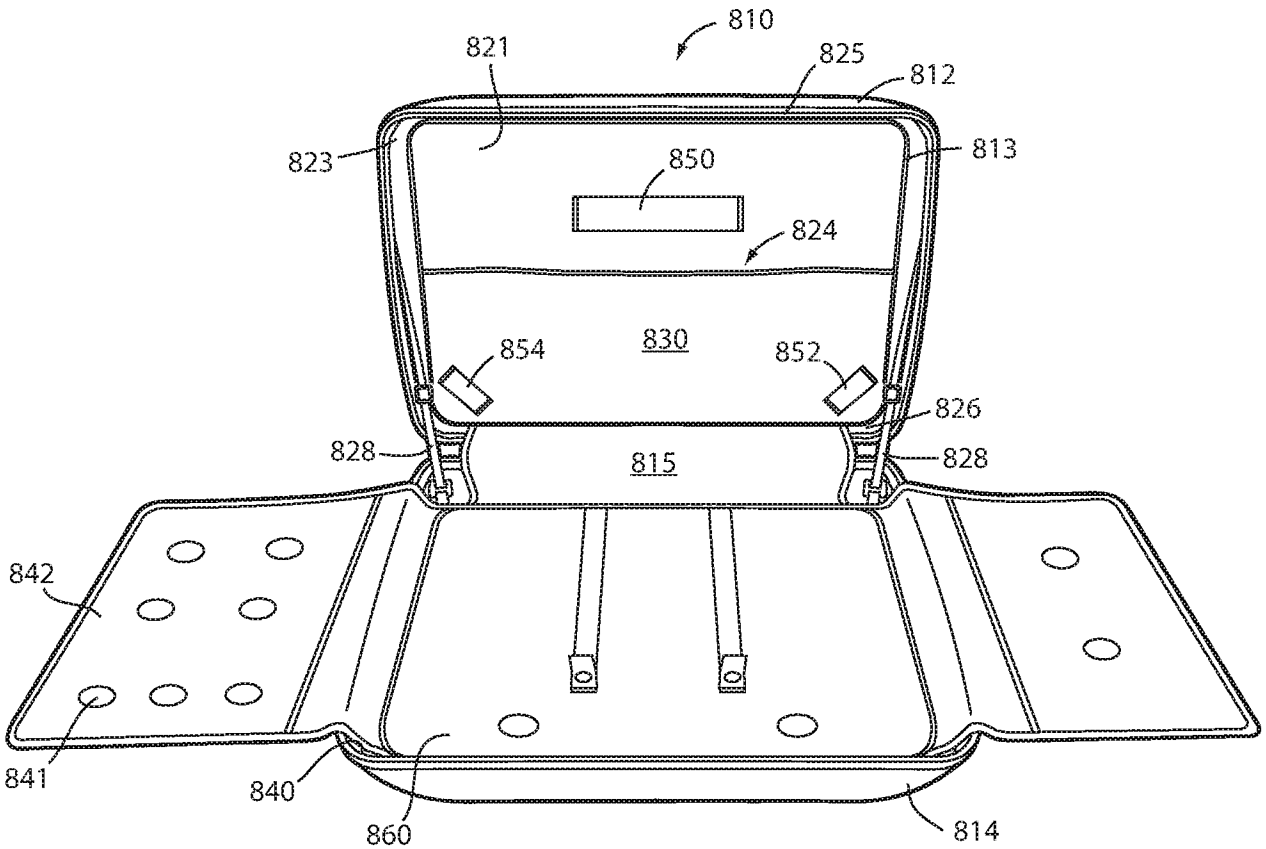
FIG. 21 is a perspective view of the system with an open case.
Figure 23:
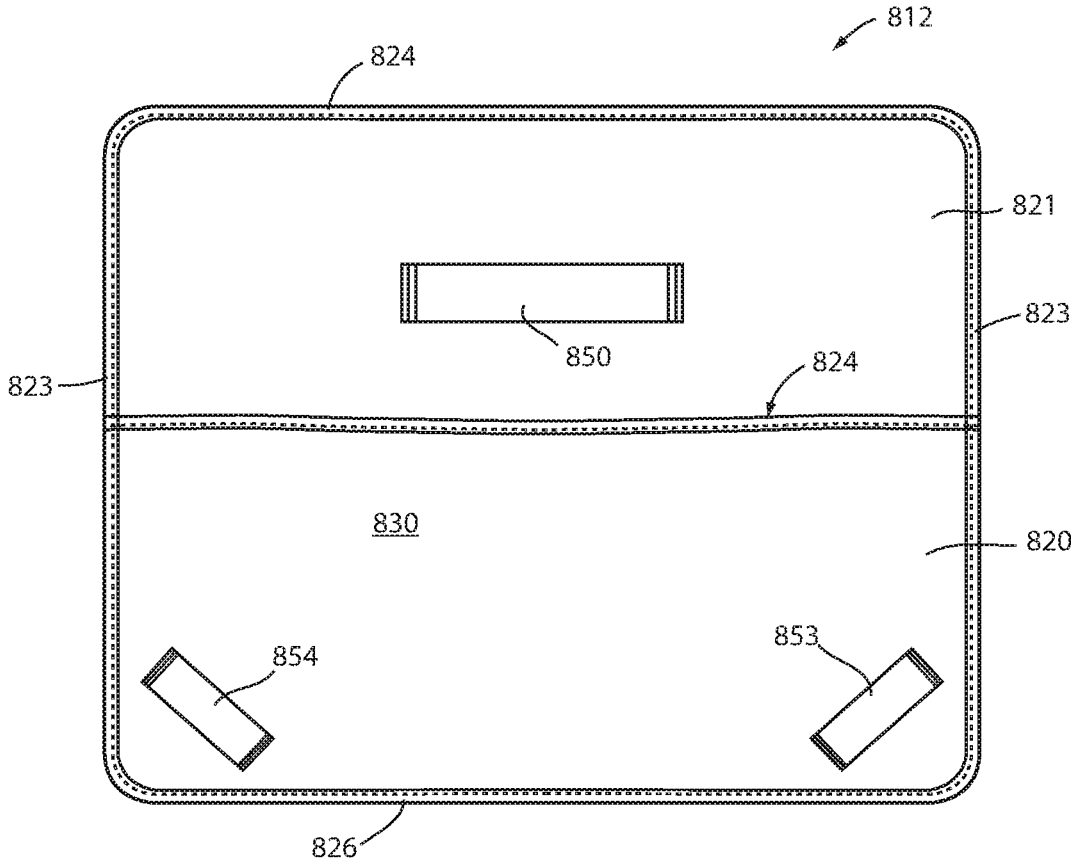
FIG. 23 is a plan view of the inside upper portion of a case.

The case 810 as shown in FIGS. 21-23 may be constructed of foam as described with respect to FIGS. 17A-17D or a harder and/or more dense material as described herein with respect to FIG. 18. The case 810 may include a first or top portion 812 connected to a second or bottom portion 814 by a functional hinge 815 such as the flexible flap shown in FIG. 21. The top portion 812 may have defined therein an upper cavity 820. The upper cavity 820 may include a back wall 821 and side walls 823, top wall 825, and bottom wall 826. Optionally, the case may also be constructed with a "skin", such as a removable skin that can be removed so that a user may change the color or appearance of the case by simply replacing the skin.

A mirror, such as mirror assembly 310 (FIG. 26), may be placed in the upper cavity 820 to thereby form a cosmetic system 800 similar to system 100 described above. Further, case 810 may enclose other accessories, such as the compact 420, the brush holder 440, including a brush holder with the separable, detachable base 446, the pouch 410*a*, and/or bag 412, all described above. The back wall may include straps 850, 852, 824 sewn or otherwise fixed on the back wall 821. The straps may be stretchable and adapted to receive hooks (not shown) on the mirror assembly to secure the mirror in the upper cavity 820. The angle of travel between the top portion 812 and the bottom portion 814 may be limited as desired by adjustable straps 828. The angle of the mirror, when present in the upper cavity 820, may similarly be controlled by adjusting the straps 828.

Upper cavity 820 may also include a pocket 824 formed by a panel of material 830 secured on three sides to the back wall 821. In this manner, when the mirror is removed, the pocket will be accessible.

The bottom portion 814 of the case 810 may include a bottom cavity 840 in which a trifold 860 may be fixed or removably placed. The trifold 860 may of the type described with respect to FIGS. 7A, 7B, 8, and 9. The case 810 and trifold 860 may be part of a system, similar to the system 100 described with respect to FIG. 5. The trifold 860 may be constructed to arrange and carry cosmetics and accessories, for example, as described with respect to the trifold insert 200 of FIG. 5.

Figure 25:
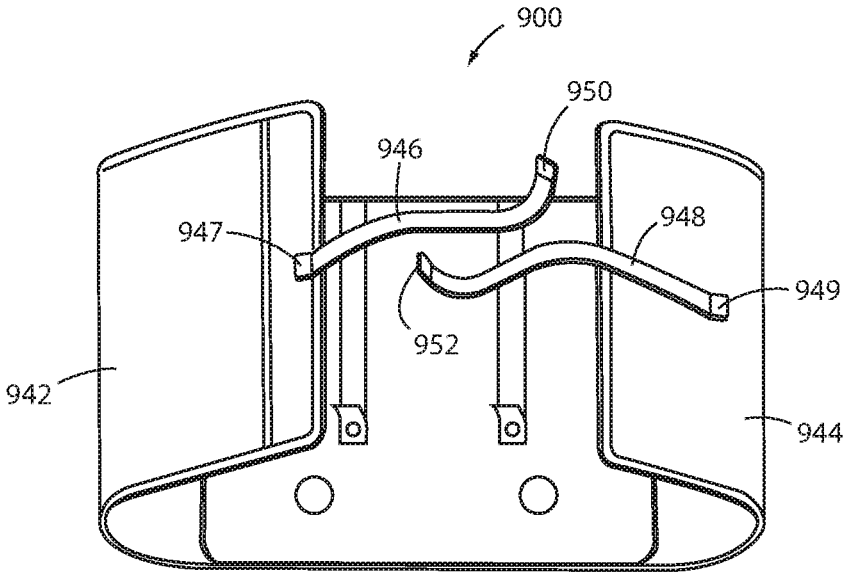
FIG. 25 is a front perspective view of a trifold of the system with ties.
Figure 26:
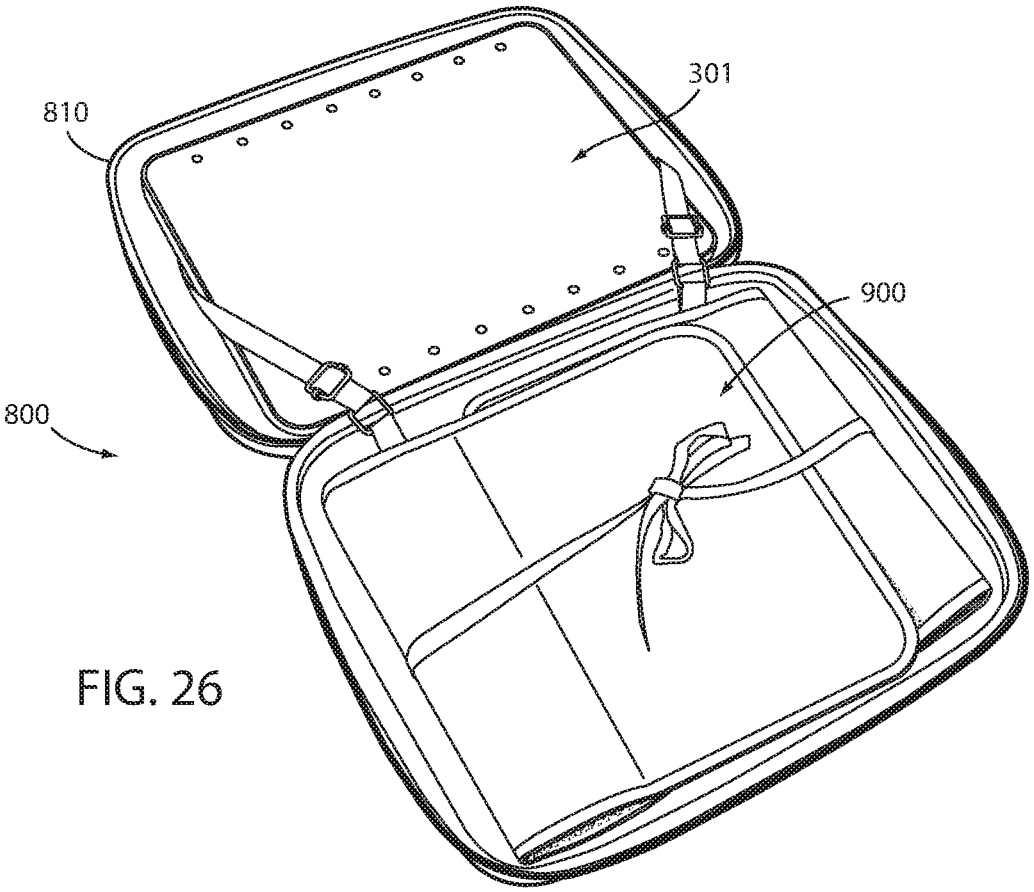
FIG. 26 is a perspective view of the case of FIG. 20 opened showing a mirror assembly and the trifold of FIG. 25 housed in the case.

As shown in FIGS. 25 and 26, another embodiment of the system and/or case may include a trifold 900 with a length of material, such as ribbon 946 attached at one end 947 to the left panel 942 of the trifold 900. Similarly, ribbon 948 can be attached at one end 949 to the right panel 944. The free ends 950, 952 may be tied together to secure the panels of the trifold 900 and/or for decorative purposes. Further, trifold 900 may be removably attached, for example, by fasteners, such a snaps, VELCRO patches, or ties, to case 810 in bottom cavity 840 or may be attached, for example, by an adhesive. For further optional details of trifold 900 reference is made above to trifold 860.

While several forms of the inventions have been shown and described, the above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. For example, any reference to claim elements in the singular, for example, using the articles "a," "an," "the," or "said," is not to be construed as limiting the element to the singular. Additionally, directional terms used in the specification, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A portable cosmetic case comprising:

a bottom portion, said bottom portion having a support surface for supporting and holding cosmetic supplies and/or tools thereon, and said support surface defining a footprint;

a top portion mounted relative to said bottom portion and movable from an open position to a closed position wherein said top portion and said bottom portion define a compartment therebetween;

first and second independent makeup carriers, said first independent makeup carrier comprising a folding carrier having first and second folding sections holding therein a palette of makeup, said second independent makeup carrier having a compartment for holding a plurality of makeup tools therein, said first section of said first independent makeup carrier forming a rear surface of said first independent makeup carrier, said second section of said first independent makeup carrier forming a front side of said first independent makeup carrier when folded about said first section, and said second independent makeup carrier having a rear surface and a front side;

first and second panels connected to a base panel and operable to fold into said bottom portion in a closed position relative to said base panel to define an interior space at least partially surrounding said first and second independent makeup carriers and to unfold to an open position outside said footprint of said bottom panel to define with said base panel a vanity working area of said cosmetic case, said first and second panels each having a footprint, said first panel having a mounting surface—with a plurality of releasable couplers mounted thereon and configured to releasably engage said rear surface of said first independent makeup carrier to releasably surface mount said first portion of said first independent makeup carrier to said mounting surface of said first panel but without engaging said second portion or said front side of said first independent makeup carrier and allowing unfolding of and use of said first independent makeup carrier while mounted to said mounting surface of said first panel wherein said second portion extends beyond said footprint of said first panel when unfolded to increase said vanity working area of said cosmetic case; and said second panel having a mounting surface with a plurality of releasable couplers configured to releasably engage said rear surface of said second independent makeup carrier to releasably surface mount said second independent makeup carrier to said mounting surface of said second panel but without engaging said front side of said second independent makeup carrier to allow use of said second independent makeup carrier while mounted to said second panel wherein each of said first and second independent makeup carriers and the cosmetic supplies and/or tools supported on said base are accessible for use at the same time.

2. The case according to claim 1 wherein said base panel and said first and second panels form a tri-fold.

3. The case according to claim 1 wherein a second independent makeup carrier is an accessory bag.

4. The case according to claim 3 wherein said accessory bag is a zippered bag.

5. The case according to claim 3 wherein said accessory bag is a drawstring bag.

6. The case according to claim 1 further comprising a mirror housed in said cover.

7. The case according to claim 6 wherein said mirror is supported in a position relative to said to said first and second panels wherein when said top portion is lifted open and said first and second panels are unfolded to said open position a user has access to said first and second independent makeup carriers, said mirror, and the cosmetics and/or tools at the same time.

8. The case according to claim 1 wherein said couplers comprise magnets.

9. The case according to claim 1 wherein said couplers comprise suction cups.

10. The case according to claim 6 wherein said mirror comprises: a stand; a plurality of lights; a light power source; and a light power switch.

11. The case according to claim 6 wherein said mirror is releasably mounted in said cover.

12. The case according to claim 1 further comprising a strap and strap attachments for removably attaching said strap to said case.

* * * * *